US005528804A

United States Patent [19]

Dalla Vecchia

[11] Patent Number: 5,528,804

[45] Date of Patent: Jun. 25, 1996

[54] TEASELING AND/OR FLUFFING MACHINE FOR FABRIC AND KNITWORK

[75] Inventor: Gino Dalla Vecchia, Santorso, Italy

[73] Assignee: Sperotto Rimar S.p.A., Thiene, Italy

[21] Appl. No.: 291,457

[22] Filed: Aug. 17, 1994

[30] Foreign Application Priority Data

Aug. 30, 1993 [IT] Italy ..... MI93A1862

[51] Int. Cl.[6] ..... D06C 11/00

[52] U.S. Cl. ..... 26/33; 26/29 R

[58] Field of Search ..... 26/29 R, 31, 32, 26/33, 34, 35, 27, 28

[56] References Cited

U.S. PATENT DOCUMENTS

| | | | |
|---|---|---|---|
| 511,609 | 12/1893 | Gessner | 26/33 |
| 633,664 | 9/1899 | Schneider | 26/33 |
| 1,019,515 | 3/1912 | Mullers | 26/33 |
| 1,030,657 | 6/1912 | Greene | 26/33 |
| 2,923,998 | 2/1960 | Miessen | 26/33 |
| 3,235,934 | 2/1966 | Miller | 26/33 |
| 3,328,862 | 7/1967 | Mullers | 26/33 |

*Primary Examiner*—Amy B. Vanatta
*Attorney, Agent, or Firm*—Cushman Darby & Cushman

[57] ABSTRACT

A teaseling and/or fluffing machine for fabric, including a load-bearing structure having two sidepieces supporting at least one drum which rotates about a central shaft and supports on its two lateral endpieces two series of teaseling and/or fluffing rollers of with-pile type and against-pile-type. These rollers are arranged along generatrices of the drum, with those of one series rotating relative to those of the other under independent drive. A fabric to be treated passes about the teaseling and/or fluffing rollers and is fed to the machine by a driven feed roller and extracted therefrom by a driven exit roller. There also being provided brushes which interact alternately with the teaseling and/or fluffing rollers. The with-pile and against-pile teaseling and/or fluffing rollers are provided with supports. They rotate rigidly with each other and are provided with structure which causes them to undergo axial shifting combined with their rotary movement, so as to achieve equalization of the action on the fabric both in the warp direction and in the weft direction.

2 Claims, 3 Drawing Sheets

TEASELING AND/OR FLUFFING MACHINE FOR FABRIC AND KNITWORK

BACKGROUND OF THE DISCLOSURE

This invention relates to a teaseling and/or fluffing machine for fabric and knitwork.

Known teaseling and/or fluffing machines are composed essentially of one or more drums rotating with predetermined direction and speed, along their circumference there being housed a certain number of teaseling and/or Fluffing rollers. If the rollers are teaseling rollers they are embraced by cloth carrying needles extending alternately in the same direction as the fabric (with the pile) and in the opposite direction (against the pile), these rollers rotating about respective longitudinal axis shafts under independent control. The same applies to fluffing rollers, which carry an abrasive paper covering instead of cloth carrying needles. These rollers also rotate with predeterminable speed and direction.

The fabric to be teaseled and/or fluffed wraps about a considerable part of the drum circumference and part of the teaseling and/or fluffing rollers, the fabric being fed via an entry roller and extracted from the drum via an exit roller. These entry and exit rollers also rotate at predetermined speed, depending on the working or advancement speed of the fabric.

The speed of the two rollers can be different and predetermined in relation to the desired fabric tension.

In particular, the teaseling and/or fluffing rollers have a speed and direction of rotation predetermined on the basis of the required effects, but have a single rotary movement such as to effect on the fabric an operation of fibre extraction and abrasion only in the direction of the fabric warp; they hence perform a reduced and unbalanced action because any operation in the direction of the fabric weft is lacking.

This results in non-homogeneous action on the fabric surface.

SUMMARY OF THE INVENTION

The object of the present invention is to solve the aforesaid problems.

This object is attained according to the present invention by a teaseling and/or fluffing machine for fabric and knitwork comprising essentially a load-bearing structure consisting of two sidepieces supporting at least one drum which rotates about a central shaft and supports on its two lateral endpieces two series of teaseling and/or fluffing rollers of with-pile and against-pile type, these being arranged along the generatrices of the drum with those of one series rotating relative to those of the other under independent drive, a fabric to be treated passing about the teaseling and/or fluffing rollers and being fed to the machine by a driven feed roller and extracted therefrom by a driven exit roller, there also being provided brushes which interact alternately with the teaseling and/or fluffing rollers, characterised in that the with-pile and against-pile teaseling and/or fluffing rollers are provided with support means, they rotate rigidly with each other and are provided with means which cause them to undergo axial shift combined with their rotary movement, so as to achieve equalization of the action on the article both in the warp direction and in the weft direction.

BRIEF DESCRIPTION OF THE DRAWINGS

The characteristics and advantages of a teaseling and/or fluffing machine according to the present invention will be more apparent from the ensuing description given by way of non-limiting example with reference to the accompanying schematic drawings, in which.

DETAILED DESCRIPTION

Figure 1:
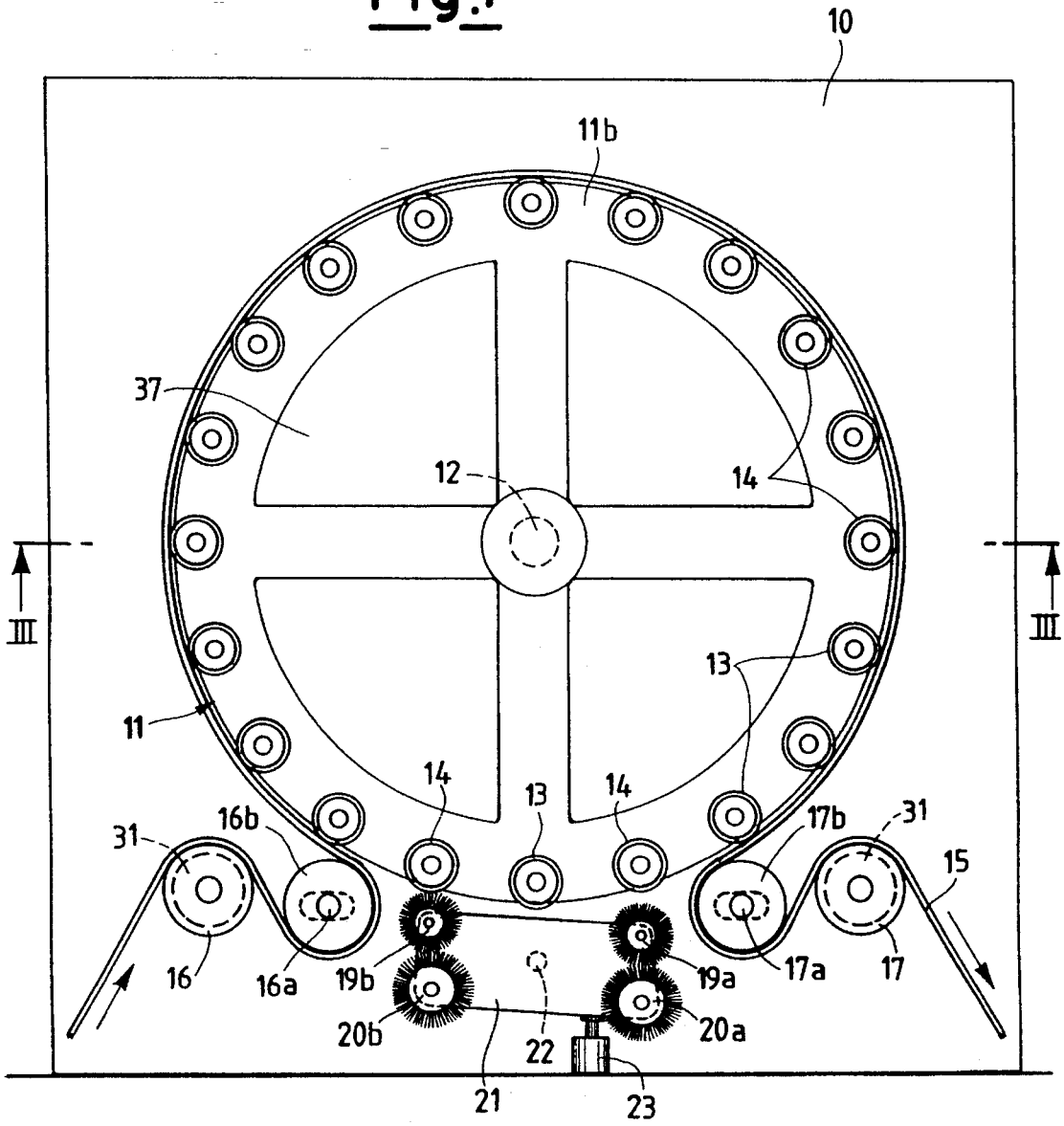
FIG. 1 is a cross-section through the teaseling and/or fluffing machine according to the present invention taken on the line I—I of FIG. 3.

The figures show a teaseling and/or fluffing machine for fabric and knitwork according to the present invention.

The teaseling and/or fluffing machine comprises essentially a load-bearing and containing structure consisting generally of two sidepieces 10, on which there is supported a drum 11 rotating about a central motorized shaft 12. The endpieces 11*a*, 11*b* of the drum 11 support two series of teaseling and/or fluffing rollers, respectively with the pile 13 and against the pile 14, arranged along generators of the drum 11. In addition, the rollers 13 and 14, for example alternate individually with each other and rotate with independent drive and direction one to the other.

A fabric 15 to be treated passes partially about the drum 11 and over the teaseling and/or fluffing rollers 13 and 14 and is fed by feed roller 16, but before passing onto the drum and over the teaseling and/or fluffing rollers 13 and 14 to be extracted by an exit roller 17 it passes about and is controlled by further rollers 16*b* and 17*b*.

The feed roller 16 and exit roller 17 are located in proximity to two groups of teaseling and/or fluffing roller cleaning brushes indicated by 19*a*, 20*a* and 19*b*, 20*b*.

Both the brush groups are made alternately and selectively active, the first group always on the with-pile teaseling and/or fluffing rollers 13 and the second group always on the against-pile teaseling and/or fluffing rollers 14.

Figure 2:
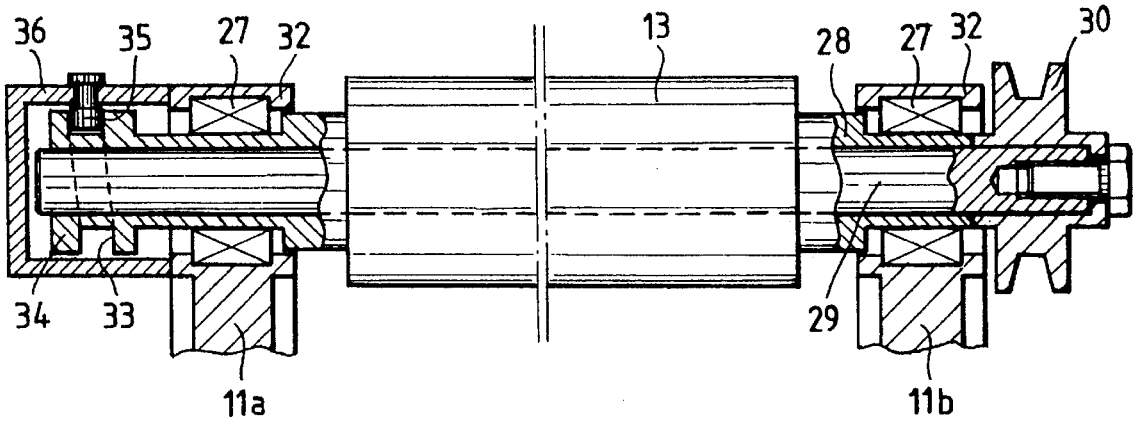
FIG. 2 is an enlarged view of a teaseling and/or fluffing roller shown partly in section.
Figure 3:
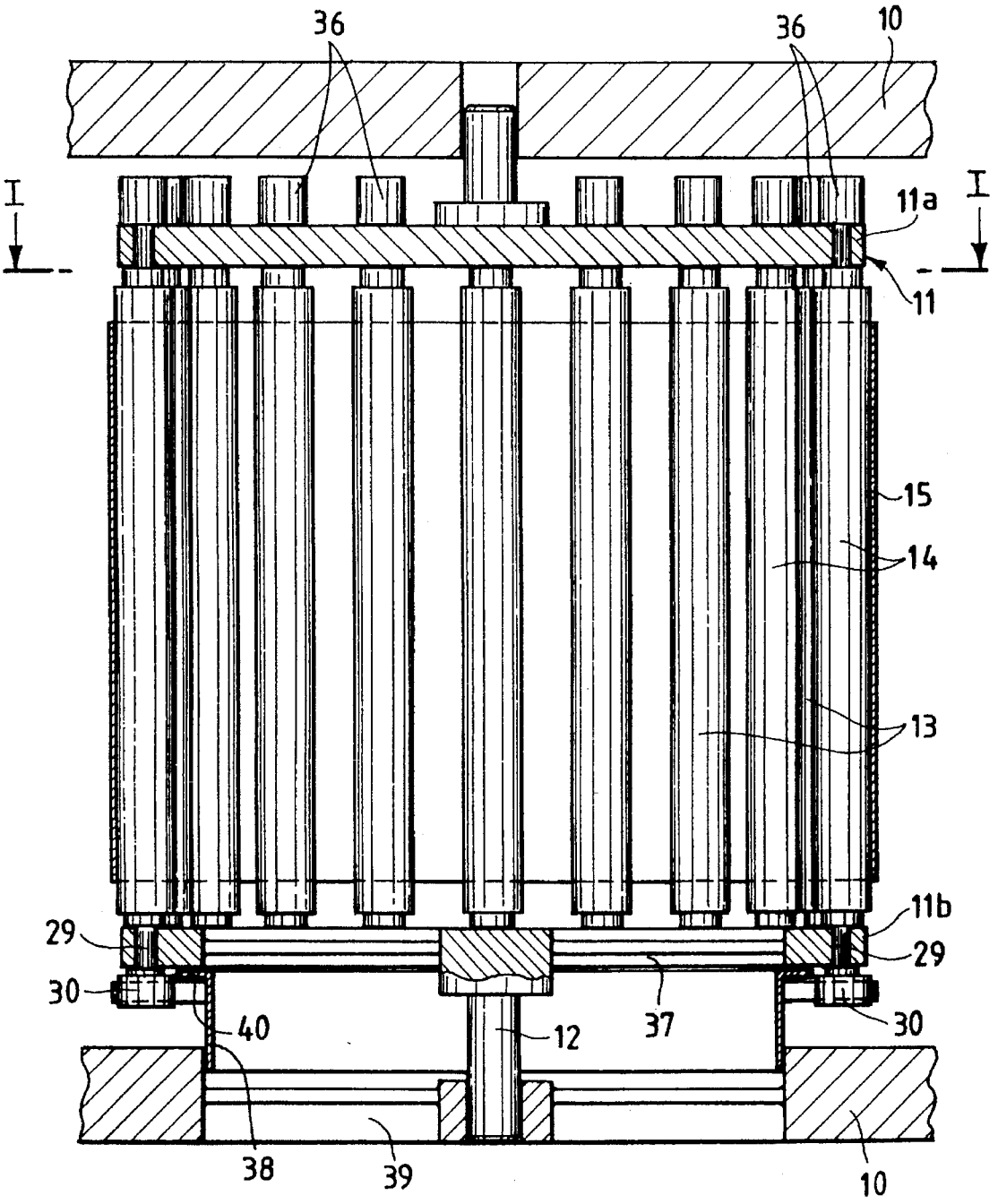
FIG. 3 is a section on the line III–III of FIG. 1.

According to the present invention, as shown in FIG. 2, each of the teaseling and/Or fluffing rollers of with-pile type 13 (or against-pile type 14) is supported on support means consisting of roller bearings 27 secured to the lateral endpieces 11*a* and 11*b* of the drum 11.

More specifically, the teaseling and/or fluffing rollers 13 or 14 are made rigid with a sleeve 28 which is inserted into the roller bearings 27. A shaft 29 passes internally through the sleeve 28 and rotates rigidly with it, the shaft 28 and sleeve 29 being rotated by an end pulley 30. The end pulley 30 interacts with a pair of transmissions connected respectively to all the with-pile rollers 13 and to all the against-pile rollers 14 so that their achieve their independent rotation.

Support portions 32 of the lateral endpieces 11*a* and 11*b* at which the roller bearings 27 are secured have apertures such as to enable the sleeve 28 to move axially by virtue of the provision of means determining an axial shift combined with the rotary movement, such as cam means.

The cam means determining the shift according to the invention are formed by providing a perimetral recess 33 in an enlarged extension 34 of one of the sleeves 28. Into the recess 33, arranged so as to be inclined to the roller axis, there is inserted a pawl 35 which is rigid with a box extension 36 of one of the supports 32 and which projects inwards.

The enlarged extension 34 provided with the recess 33 acts as a cam, and in cooperation with the pawl 35 causes the roller to undergo axial shift when rotated by the pulley 30 or by the respective transmission, not shown.

Depending on the shape of the cam and on the possible adjustment of the inclination of its recesses 33 to the roller axis, the teaseling and/or fluffing roller can undergo one or more shifts per revolution, the amplitude of the shift being predeterminable. This arrangement favours a teaseling and/or fluffing operation with more balanced action between the weft and warp, to achieve a greater fabric yield, homogeneity and strength as a result. A teaseling and/or fluffing machine according to the invention has the advantage of balancing the teaseling and/or fluffing action along the weft and warp.

This balanced action is achieved by the reciprocating axial shift combined with the rotary motion of the teaseling and/or fluffing rollers. In this manner, a greater treatment homogeneity, a greater covering intensity effect with lesser loss of strength of the article, and a greater yield are all achieved.

I claim:

1. A machine for teaseling and/or fluffing pile of a fabric being fed to and extracted from the machine, comprising:

a load-bearing structure comprising two side pieces;

at least one drum having a central shaft supported in said side pieces for rotation of the drum about said shaft, said drum having a circumference defined by a succession of generatrices;

said drum having two axially opposite end pieces which support between them in respective roller bearings two intercalated series of fabric pile-treating rollers for at least one of teaseling and fluffing the pile, said rollers being arranged along respective generatrices of said drum;

one said series of said rollers having a drive driving them for rotation in a first direction which corresponds to a direction of lay of said pile from said fabric, and the other said series of said rollers having a drive driving them for rotation in a second direction which is opposite to said direction of lay of said pile;

a motor-driven feed roller disposed adjacent said drum at a first location;

a motor-driven exit roller disposed adjacent said drum at a second location which is displaced angularly about said circumference of said drum from said first location, so that the fabric can be fed by contact with said feed roller into contact with said rollers of the said series, about a portion of the circumference of the drum and extracted by contact with said exit roller;

a plurality of cleaning brushes supported adjacent said circumference for cleaning engagement with rollers of said one and other series;

the rollers in each said series being respectively interconnected for coordinating rotational speed thereof; and the rollers in each said series being provided with cam and cam-follower arrangements for axially reciprocatingly shifting said rollers for tending to equalize both weftwise and warpwise of said fabric treatment being applied by said rollers to said fabric as said fabric advances in interaction with said machine.

2. The machine of claim 1, wherein:

each said cam comprises a radially outwardly opening groove formed in a respective sleeve fixed on a shaft of the respective roller for rotation therewith; and each said cam follower comprises a radially inwardly projecting pawl mounted to a respective said end piece and projecting into a respective said groove.

* * * * *